United States Patent [19]

Pfahl, Jr.

[11] 4,238,186

[45] Dec. 9, 1980

[54] METHODS AND APPARATUS FOR HEATING ARTICLES SELECTIVELY EXPOSED TO A GENERATED VAPOR THROUGH A VOLUME CONTROLLABLE VAPOR BARRIER

[75] Inventor: Robert C. Pfahl, Jr., Bethlehem, Pa.

[73] Assignee: Western Electric Company,Inc., New York, N.Y.

[21] Appl. No.: 966,412

[22] Filed: Dec. 4, 1978

[51] Int. Cl.[3] ..... F27D 7/00

[52] U.S. Cl. ..... 432/10; 34/26; 34/34; 165/105; 432/66; 432/197; 432/226

[58] Field of Search ..... 432/10, 66, 197, 226; 34/26, 32, 34, 75; 165/105

[56] References Cited

U.S. PATENT DOCUMENTS

| | | | |
|---|---|---|---|
| 2,176,348 | 10/1939 | Juettner | 260/515 |
| 3,479,252 | 11/1969 | Holm et al. | 202/170 |
| 3,793,076 | 2/1974 | Lea | 134/25 |
| 3,866,307 | 2/1975 | Pfahl, Jr. | 29/498 |
| 3,904,102 | 9/1975 | Chu | 228/180 |
| 4,022,371 | 5/1977 | Skarvinko | 228/223 |
| 4,022,932 | 5/1977 | Feng | 427/93 |
| 4,055,217 | 10/1977 | Chu | 165/1 |
| 4,077,467 | 3/1978 | Spigarelli | 165/105 |

OTHER PUBLICATIONS

Article entitled "Solvent Vapor Solder Reflow", by E. G. Dingman, IBM Technical Disclosure Bulletin, vol. 13, No. 3.

*Primary Examiner*—John J. Camby
*Attorney, Agent, or Firm*—K. R. Bergum

[57] ABSTRACT

Several methods and apparatus (10, 60) are disclosed for vapor condensation heating only a selected underside surface area of an article (18, 18') while continuously minimizing loss of the generated vapor (**26*b*, 26*b*') to the atmosphere. In accordance with several preferred embodiments, a composite vessel (11, 11') is formed with a lower stationary sidewall section (14), including venting means (28, 29, 31, 32, 34), and a channel (41) adapted to telescopically receive an upper, internally cooled and retractable sidewall section (13, 44, 13', 44') in a manner that establishes a vapor barrier (27) of controllable volume therewithin. As such, an article (18, 18') to be heated, when initially mounted on the top of the upper sidewall section (13, 13') may thereafter be readily displaced downwardly such that only a selected underside surface area thereof is controllably brought into contact with, and heated by, a single heat transfer liquid (26)—generated body of hot vapor (26*b*, 26*b*'**) confined therebelow.

22 Claims, 3 Drawing Figures

METHODS AND APPARATUS FOR HEATING ARTICLES SELECTIVELY EXPOSED TO A GENERATED VAPOR THROUGH A VOLUME CONTROLLABLE VAPOR BARRIER

BACKGROUND OF THE INVENTION

1. Field of the Invention

This invention relates to methods and apparatus for the vapor condensation heating of articles to an elevated temperature and, more particularly, to controllably exposing only a selected underside surface area of an article to be heated to a generated body of hot saturated vapor of substantially uniform volume, while continuously minimizing any loss of the vapor to the atmosphere.

2. Description of the Prior Art

In the mass soldering, fusing or brazing of articles, conventional methods and apparatus, such as involving the use of a typical soldering iron, are generally not appropriate. More specifically, there has developed an urgent need in the electronics industry for methods and apparatus for performing mass (or selected) soldering (or unsoldering) operations on complex printed circuit boards which, for example, may require hundreds (or even thousands) of closely spaced connections to be soldered. It is also very desirous to be able to carry out such soldering operations in a manner that obviates the formation of surface oxidation in the absence of flux being applied to the solder areas.

Although the present invention is not to be construed as limited to a particular type of heat-induced operation, the nature thereof is most readily understood in the context of performing a soldering (or unsoldering) operation on an article, particularly on one surface thereof, such as on a selected underside surface of a printed circuit board, during the manufacture or repair thereof.

In a typical hand soldering operation, utilizing a soldering iron, as well as in a conventional automated wave soldering operation, a coating of flux has normally been required, and applied on at least the article areas to be soldered, in order to minimize any deleterious oxide surface build-up during soldering.

In order to overcome the troublesome manufacturing problems associated with oxide surface build-up, and the attendant need for flux, there has recently been increasing use made of vapor condensation soldering processes and apparatus. One such process and apparatus is the subject of U.S. Pat. No. 3,866,307 of R. C. Pfahl, Jr. et al, issued Feb. 8, 1975, assigned to the assignee of the present invention, and incorporated herein by reference.

In accordance with the teaching of the prior Pfahl et al. patent, the article to be soldered (fused or brazed) is placed within a vessel that is open to the atmosphere on the top side so as to facilitate the entry and removal of the article therefrom. Each article to be heated to a desired elevated temperature is immersed within a primary body of hot saturated vapor generated within the vessel, with a portion of the vapor body condensing on the article and transferring thereto its latent heat of vaporization. This heats the article to the temperature required to perform a soldering operation, for example, thereon. The hot saturated vapor body is generated by continuously boiling within the vessel a heat transfer liquid that is non-conducting, chemically inert, and has a boiling point at least equal to, but preferably above, the temperature required to melt the solder. Such a vapor condensation facility may also be employed to perform a mass re-flow soldering operation on a continuously moving line of articles.

The various preferred heat transfer liquids presently employed to heat articles in the manner described above, and which liquids are described in greated detail hereinbelow, are quite expensive. As such, any appreciable loss of the generated vapor in question to the atmosphere significantly impacts on the over-all costs incurred in carrying out a given soldering operation, particularly high volume mass soldering operations.

One technique utilized heretofore to at least partially minimize the loss of the relatively expensive primary vapor to the atmosphere in an open top vessel has has involved positioning a suitable cooling coil (or coils) about the inner stationary sidewalls of the vessel at an elevation near the top thereof. Such a cooling coil (or coils) establishes a so-called vapor barrier that condenses any vapor that rises to the elevation, and in the immediate vicinity, of the coils. This technique, however, is not always completely effective in condensing the major portion of the rising vapor in the central region of the vessel unless the established vapor barrier has appreciable depth. A vessel that incorporated both a peripherially disposed cooling coil and a completely enclosing, but removable, top wall or cover is disclosed in U.S. Pat. No. 4,022,371 of E. R. Skarvinko et al. Such an apparatus, of course, not only requires the total immersion of the articles within the vapor, but the removal and re-positioning of the cover from the vessel in connection with each heating operation, with the attendant loss of vapor to the atmosphere at such times.

A more effective technique recently developed to minimize the loss of the relatively expensive heat transfer liquid to the atmosphere, while in vapor form in an open top vessel, is the subject of U.S. Pat. No. 3,904,102 of T. Y. Chu et al, issued Sept. 9, 1975, also assigned to the assignee of the present invention. In accordance with the technique disclosed in the last-mentioned reference, a secondary body of vapor, generated by boiling a relatively inexpensive heat transfer liquid, is interposed between the relatively expensive primary body of vapor and the atmosphere. This technique substantially reduces loss to the atmopshere of the hot primary body of vapor confined therebelow. Another form of such apparatus is disclosed in U.S. Pat. No. 4,077,467 of D. J. Spigarelli.

Although such a secondary body of vapor has been found to be quite effective in reducing the losses of the expensive primary vapor, portions of both the primary and secondary vapors are nevertheless still lost to the atmosphere across the secondary vapor-air interface. One reason for this is believed to be the disturbance produced at the primary-secondary vapor interface when normally generating the secondary vapor. The dual vapor losses in question are at least substantially further minimized, however, in accordance with a method and apparatus for more effectively maintaining the secondary vapor body, disclosed in U.S. Pat. No. 4,055,217 of T. Y. Chu, also assigned to the assignee of the present invention, as well as in accordance with the specialized apparatus disclosed in the aforementioned patent of Spigarelli.

With respect to all of the aforementioned dual vapor body generating condensation systems, it is appreciated, of course, that the articles to be heated must be passed downwardly through the upper secondary vapor body in order to be immersed in the primary vapor body. This presents no serious problem with respect to many articles, including certain types of printed circuit boards with only printed circuitry thereon, or having components and/or devices mounted thereon which are not adversely affected by the elevated temperatures of the primary vapor body, in particular.

In an ever-increasing number of mass soldering circuit board applications today, however, the mounted active and passive electronic devices and/or components, particularly when of the solid state integrated circuit type, cannot be safely subjected to a hot saturated vapor body for even relatively short periods of time, and particularly at the elevated temperatures required for soldering. In such cases, and with particular reference to circuit boards, with components mounted on only one side, it would be very desirous to controllably expose only the non-component, printed circuit side thereof to be soldered (hereinafter referred to simply as the underside) to a single hot, saturated (primary) vapor body confined within a vessel, i.e., with no immersion of the completely assembled circuit board within the vapor body. In order to obviate the need of circuit board immersion, of course, the upper boundary, or elevation of the generated body of hot vapor must be well defined.

Such a controlled vapor exposure technique would also be of considerable advantage in the repair of circuit boards, wherein both unsoldering and resoldering operations are normally involved. In this regard, it would likewise be very beneficial if only selected discrete areas on the underside of the circuit board would have to be subjected to the heat of vaporization of a generated body of vapor while, at the same time, minimizing the loss of any vapor to the atmosphere in the absence of an overlying secondary vapor blanket.

One technique employed heretofore to heat only the underside of a printed circuit board in a vapor condensation apparatus has involved a vessel which incorporates an internally cooled and retractable cover plate, the latter being adapted to minimize loss to the atmosphere of vapor generated within the vessel, while allowing the vapor to rise to the top thereof so as to perform, for example, a soldering or unsoldering operation on only the underside of a top side vessel-supported article (e.g., a circuit board). Such an apparatus is disclosed in U.S. Pat. No. 4,194,297, of R. C. Pfahl, Jr., issued Mar. 25, 1980, also assigned to the assignee of the present invention. The internally cooled and retractable cover plate utilized in that apparatus is dimensioned and mounted on the vessel at an elevation such that while in a first extended position, it substantially enclosess the top of the vessel to prevent loss of vapor to the atmosphere, and to also isolate the underside of an article from the vapor when vessel-supported above the cover plate. With the cover plate in a second retracted position, the underside of the supported article is exposed to and heated by the vapor, with the underside of the article then also functioning to enclose the otherwise open top of the vessel. By also preferably tilting the cover plate at a slight angle relative to the underside of the article, any hot vapor that may become entrapped therebetween, prior to the removal of the heated article from the vessel, is substantially completely condensed, with the cover plate allowing the condensate to flow by gravity back to the remaining nonvaporized heat transfer liquid therebelow.

An article entitled "Solvent Vapor Solder Reflow", by E. G. Dingman, IBM Technical Disclosure Bulletin, Vol. 13, No. 3, dated Aug. 1970, describes the use of a boiling solvent (such as that sold under the tradename "Freon E5", by E. I. DuPont de Nemours and Company) to facilitate the removal and resolder of electronic components during printed circuit board rework operations. It is stated therein that "The solvent condenses only on the areas having a temperature lower than the boiling point of the solvent used. This releases the heat of vaporization and enables solder rework operations with materials and components that are heat sensitive. The rapid and selective application of heat to small areas with high thermal conductivity is possible within a matrix of material such is heat sensitive and cannot tolerate high temperatures." While this disclosure discusses the rapid and selective application of heat to small areas of high thermal conductivity, such as the metallic pads, land areas, lead ends and circuit paths of printed circuits boards, there is no suggestion of how to controllably expose a hot saturated vapor body either to only one surface of a printed board having both low and high thermal conductivity areas thereon or, alternatively, to only selective discrete regions encompassed within the areas of high thermal conductivity. Moreover, no physical structure is either illustrated, or described, for accomplishing even the described mode of operation and, particularly, in relation to simultaneously preventing or minimizing loss of vapor to the atmosphere.

It was further appreciated heretofore that other less analogous prior art apparatus also existed of the aforementioned type that requires the confinement of an article within an enclosed vapor generating vessel incorporating some form of cooled top or sidewalls. For example, B. Juettner U.S. Pat. No. 2,716,348 discloses a vessel with a horizontally disposed, water-cooled, top-enclosing cover (removable but not retractable). K. A. Holm et al. U.S. Pat. No. 3,479,252 discloses a sectioned vessel with a removable top portion having water-cooled sidewalls and an air-flow, channel-defining top wall. B. C. Feng U.S. Pat. No. 4,022,932, discloses a completely enclosed and non-cooled vessel, utilizing a simple detachable cover, for making patterned resist masks.

From the foregoing, and with particular reference to vapor condensation apparatus, it is seen that a number of different approaches have been taken with respect to heating either the entire article, or a selected surface area thereof, while simultaneously providing means to minimize the loss of the generated vapor to the atmosphere. While the above-described vessel utilizing a retractable, internally cooled cover plate provides a rather effective way of providing selective underside article surface heating with a minimal loss of vapor to the atmosphere, it would nevertheless be very desirable if the upper boundary of the generated body of vapor could remain relatively stationary at all times within the vessel, in the absence of any type of vessel cover plate, or a secondary vapor blanket, and regardless of whether or not an article to be heated was positioned on the vessel, and/or was selectively exposed to the body of vapor.

Such an upper boundary confined vapor body would, for all practical purposes, obviate the problem of any non-condensed vapor, such as entrapped between a vessel-mounted article and an underlying retractable (or otherwise removable) cover plate, from escaping to the atmosphere. Of course, any attempt to utilize a secondary vapor blanket, as employed in several of the aforementioned prior art apparatus, rather than a vessel-enclosing cover plate, to minimize vapor loss, would not only necessitate the immersion of the entire article to be heated within the secondary vapor, but also within the primary vapor of much higher temperature. This follows from the fact that any attempt to lower an article down through a secondary vapor blanket to an elevation such that only the desired underside surface thereof to be heated is located at the precise primary and secondary vapor interface, would be extremely difficult to achieve, if not impossible. The same problem would arise, of course, with a conventional vapor barrier of substantially uniform volume established above a single primary generated body of hot vapor.

SUMMARY OF THE INVENTION

It, therefore, is an object of the present invention to provide a simplified, inexpensive and reliable method and apparatus for confining only one heat transfer liquid-generated vapor body within a vessel, i.e., with no secondary vapor blanket, or retractable (or otherwise removable) vessel-enclosing cover plate, to minimize loss of vapor to the atmosphere, while allowing only a selected underside surface area (or areas) of an article to be controllably exposed to, and heated by, the generated body of hot vapor.

In accordance with the principles of the present invention, the above and other objects are realized in one preferred vapor condensation method and embodiment wherein a generated body of vapor is confined within a vessel having a lower, stationary sidewall section adapted to telescopically receive an upper internally cooled and retractable sidewall section. Such a uniquely constructed vessel selectively establishes a volume controllable vapor barrier, with the vapor body-vapor barrier interface significantly remaining at a substantially stationary horizontal elevation at all times.

With such a vessel, an article, such as a printed circuit board, when initially mounted on the upper peripheral edges of the retractable upper sidewall section, may thereafter advantageously be readily displaced downwardly such that only a selected underside surface area thereof coincides with, and preferably passes slightly through the initially established vapor body-vapor barrier interface. As such, only the underside of the circuit board is controllably exposed to, and heated by, the single heat transfer liquid-generated body of hot vapor therebelow. At that time, the circuit board also cooperates with the otherwise open top vessel so as to continuously minimize the loss of any generated vapor to the atmosphere during the article heating operation.

Upon the upper vessel sidewall section being allowed to progressively rise to its uppermost quiescent position, the gradually exposed internally cooled walls thereof effectively condense any vapor that may attempt to rise above the upper peripheral edges of the lower stationary vessel sidewall section and, thereby, establish an effective vapor barrier, of progressively increasing volume, overlying the generated body of hot vapor. With the vapor barrier thus established, the depth (and volume) thereof varies from a maximum when the upper sidewall section is in its uppermost position, to a minimum, which actually reaches zero, in response to the downward displacement of a vessel-mounted article to an elevation whereat the underside thereof is brought into contact with the upper boundary of the hot body of vapor.

As the critical vapor interface remains essentially stationary while the underside of the article is moved downwardly to and preferably slightly through the vapor body-vapor barrier interface, any air that is entrapped between the underside of the article and the hot vapor interface is expelled through one or more small operably controlled vents that extend through, and are located near the upper edge of, the upper retractable sidewall section. Such vents thereby minimize the reduction of condensation heat-transfer due to the presence of noncondensible air.

A patterned mask may also be readily positioned immediately adjacent the selected underside surface of an article, such as a circuit board, to effect the selective heating of only discrete patterned areas, or regions, on the underside of the latter, when moved downwardly into contact with the hot generated body of vapor confined within the lower sidewall section of the vessel.

DETAILED DESCRIPTION OF THE DRAWINGS

Figure 1:
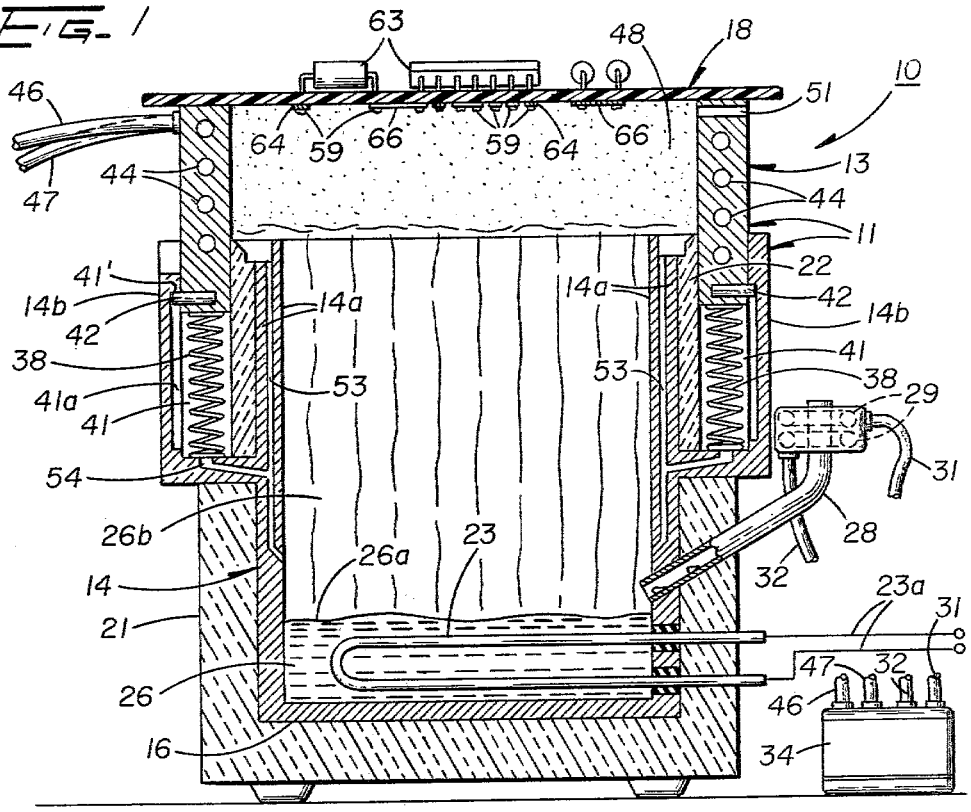
Figure 2:
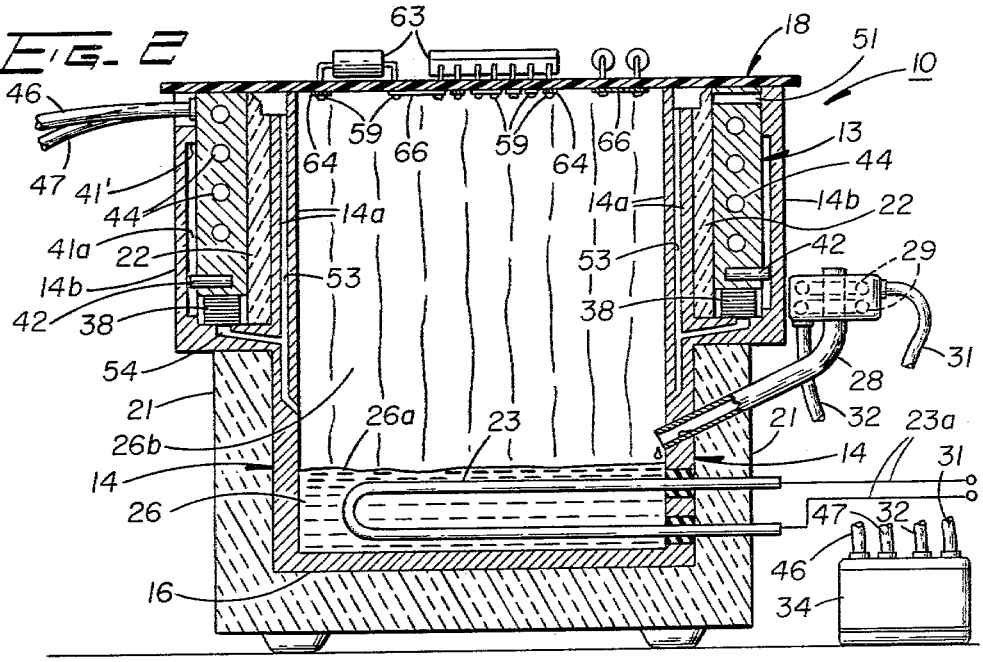
Figure 5:
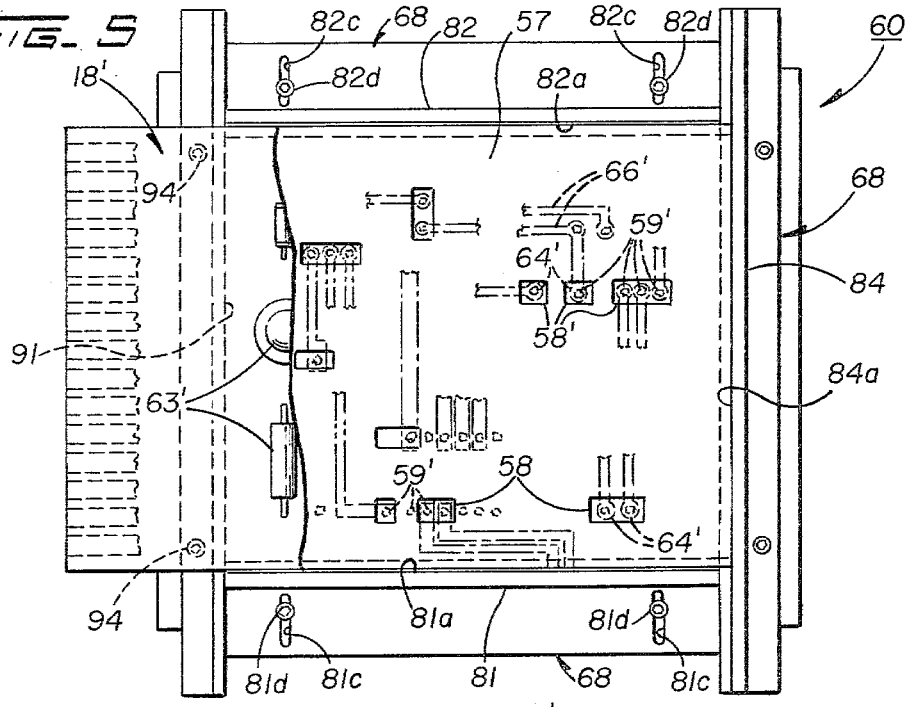
Figure 3:
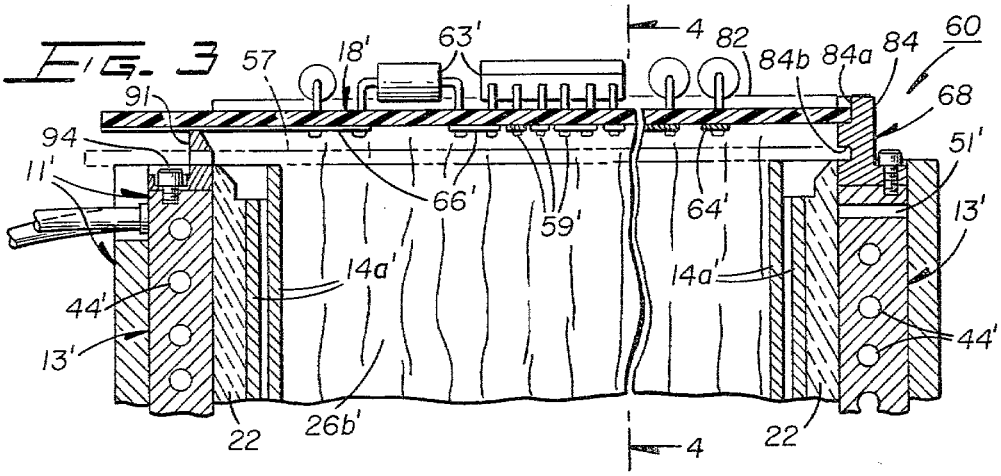
Figure 4:
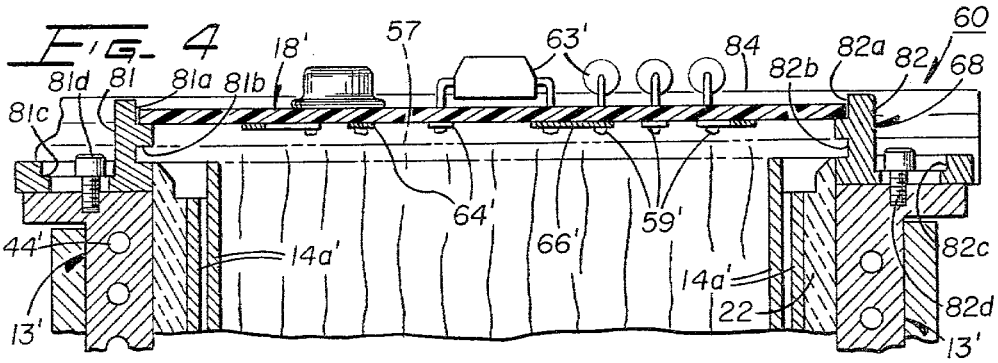

FIG. 1 is an elevational side view, primarily in section, of one preferred vapor condensation heat transfer apparatus, shown in its normal quiescent state, embodying the principles of the present invention;

FIG. 2 is an elevational side view, primarily in section, of the apparatus in FIG. 1, but with the upper retractable vessel sidewall section having been displaced downwardly and telescopically received within an accommodating channel formed within the lower stationary vessel sidewall section, in response to a representative circuit board having been placed on the upper peripheral edges of the upper sidewall section and, thereafter, displaced downwardly, preferably with light external force manually applied thereto;

FIG. 3 is an enlarged fragmentary elevational side view, primarily in section, illustrating a second preferred embodiment of the invention adapted to allow not only an article, such as a circuit board, but an optional patterned mask, to be mounted within respective channels of a guide rail assembly formed as a composite part of an upper retractable sidewall section of the vessel;

FIG. 4 is an enlarged, fragmentary elevational front view, primarily in section, of the apparatus of FIG. 3, taken along the line 4—4 of the latter FIG.; and FIG. 5 is a plan view of the second preferred embodiment of the invention, with a vessel mounted circuit board partially broken away, illustrating the use of a planar mask, having a patterned array of openings formed therein, for exposing only desired and aligned ones of a plurality of solder connection sites on the underside of the circuit board to a generated body of hot vapor confined within a vapor condensation vessel of the types embodied herein.

DETAILED DESCRIPTION OF THE INVENTION

It should be appreciated that the methods and vapor condensation apparatus as embodied herein, and described in detail hereinbelow, have universal application in heating diverse types of articles in order to perform any one of a number of different types of heat-dependent operations thereon. However, for purposes of illustration, the subject invention is disclosed herein in connection with one preferred application, namely, in performing mass (or selective) soldering (or unsoldering) operations on printed circuit boards.

With particular reference first to FIG. 1, there is depicted one preferred vapor condensation apparatus identified generally by the reference numeral 10 embodying the principles of the present invention. This apparatus comprises a volume adjustable vessel 11, preferably formed of a suitable heat resistant metal, such as stainless steel, incorporating a uniquely constructed upper retractable sidewall section 13, a lower stationary sidewall section 14 (both described in greater detail hereinbelow), and a base 16 that is integral with the lower sidewall section. As thus constructed, the composite vessel 11 has an open top that is selectively closed by a planar configured article, such as a circuit board 18 to be heated, when properly mounted on the vessel. In this regard, it is seen from a comparison of FIGS. 1 and 2 that the upper peripheral edges of both the upper and lower vessel sidewall sections 13, 14 in the first preferred illustrative embodiment are adapted to support the circuit board, or any other similarly configured article, to be heated.

The lower sidewall section 14 is preferably covered with a lower layer 21 and an upper layer 22 of suitable heat insulating material, such as fiberglass or asbestos. It is understood, of course, that the particular construction of the insulated vessel sidewalls and base may take any one of different forms, in addition to the simplified form illustrated in FIGS. 1 and 2. Conversely, in certain applications, the insulation may be completely eliminated. For example, an uninsulated vessel may be feasible in situations where the vessel is used on only a limited basis in the repair of articles, and/or when the vessel is of very small dimensions, thereby, presenting neither a serious heat loss problem nor a serious danger to operating personnel.

The vessel 11 additionally includes a conventional heating element, or coil, 23, suitably mounted in the base region of the vessel and which, for example, is preferably electrically operated through external leads 23*a*. Such a coil is employed to boil a desired heat transfer liquid 26, initially introduced into the vessel to a suitable level indicated by the reference numeral 26*a*. The heat transfer liquid preferably is of the type having a number of desired characteristics described in greater detail hereinbelow. The heat generated by the heating coil 23 may, if desired, be supplemented by an external source of heat applied to the base 16, such as a hot plate (not shown). In the latter case, of course, the outer layer of insulating material 21 covering the base 16 of the vessel would be removed.

A stationary vent pipe 28, which preferably has a cooling coil 29 surrounding an upper terminating end region thereof, is employed to insure that the interior of the vessel is maintained at approximately atmospheric pressure, while simultaneously minimizing vapor loss to the atmosphere therethrough. The cooling coil 29 is connected through suitable tubes 31, 32 to a conventional fluid source 34, which typically would include a pump, for re-circulating coolant (e.g., chilled water) through the cooling coil.

In accordance with the principles of the present invention, as embodied in the apparatus of FIGS. 1 and 2, the lower vessel sidewall section 14 is of greater height than the upper section and, as previously noted, is stationary. Contrariwise, the upper sidewall section 13 is retractably mounted, and normally maintained at an uppermost elevation, as depicted in FIG. 1, by suitable biasing means, such as a plurality of vertically oriented helical coil springs 38, which are confined within a channel 41 formed in the lower vessel sidewall section 14. It is understood, of course, that the upper sidewall section 13 may be resiliently supported by any one of a number of different types of biasing elements, or devices, such as through the use of pneumatic air cylinders (not shown). The upper-most position of the vessel section 13 is controlled by an annular stop member 42, which is secured to a lower sidewall region thereof, and extends outwardly a short distance so as to abut against an upper shoulder 41' defined by an extended peripheral region 41*a* of the channel 41.

Also with reference to the channel 41, it is formed between inner and outer wall portions 14*a* and 14*b* respectively of the lower sidewall section, and is dimensioned to telescopically receive at least the major portion of the upper retractable sidewall section 13 whenever the latter is displaced downwardly with sufficient force to overcome the cumulative biasing forces of the coil springs 38 and, thereby, acquire the position depicted in FIG. 2. At that time, a vessel-mounted circuit board 18 would rest on the upper peripheral edges of the lower, as well as upper, sidewall section of the vessel in the first embodiment of the invention.

A cooling coil (or coils) 44 is preferably arranged along a serpentine path between the major inner and outer surfaces of the upper retractable vessel sidewall section 13 in any suitable manner. The cooling coil 44 is coupled at opposite ends through suitable conduits (or tubes) 46 and 47 to the aforementioned fluid source 34.

The internally cooled and retractable vessel sidewall section 13 performs several significant and important functions. First, when in its uppermost position, as depicted in FIG. 1, the upper sidewall section 13 establishes a vapor barrier 48 of maximum volume and, more particularly, of maximum depth within the upper region of the vessel so as to minimize the possibility of any generated vapor passing therethrough and being lost to the atmosphere. However, upon the upper vessel sidewall section 13 being fully retracted and telescopically received within the central channel 41 formed in the lower vessel sidewall section 14, it is seen that the depth of the vapor barrier 48 (and, hence, the volume thereof) is progressively decreased until it is actually reduced to zero or, in other words, becomes non-extant. This follows from the fact that while in the retracted position, the internally cooled inner surfaces of the upper sidewall section 13 are isolated from the interior of the vessel by the interposed inner wall portion 14*a* of the stationary lower sidewall section 14.

With the composite vessel 11 thus constructed, it is seen that the upper sidewall section 13 would normally only be retracted downwardly after an article, such as the circuit board 18, has been mounted on the upper peripheral edges thereof so as to effectively enclose the otherwise open top of the vessel 11. At that time, the depth (as well as volume) of the vapor barrier 48 is controllably defined between the relatively stationary upper boundary of the generated body of hot vapor and the downwardly displaceable underside of the vessel-mounted circuit board. It should be noted, however, that once a circuit board encloses the top of the vessel, the particular depth (or volume) of the vapor barrier 48 is no longer a critical parameter as far as minimizing loss of vapor to the atmosphere is concerned.

In accordance with another aspect of the invention, at least one operably controlled vent 51 is formed in and extends through the upper retractable vessel sidewall section 13 near a peripheral edge thereof. The vent 51 is selectively sealed-off by the adjacent outer wall portion 14*b* of the lower vessel sidewall section 14, as well as by the layer of insulation 22, whenever the upper sidewall section 13 is fully retracted within the channel 41 of the lower section, as depicted in FIG. 2.

The vent 51, as controllably opened and closed, insures that any air that may become entrapped between the underside of a vessel-mounted circuit board 18 and the vapor body-vapor barrier interface, is expelled through the vent in question so as to minimize the reduction of condensation heat-transfer of the generated body of hot vapor due to the presence of non-condensible air. If desired, the vent 51 could optionally be connected to the vent pipe 28, at a point below the associated cooling coil 29. This would more completely insure that no possible non-condensed vapor could ever rise into the progressively decreasing vapor barrier 48, in response to a downwardly displaced circuit board and, thereafter, be expelled with any entrapped air to the atmosphere.

A condensate return channel 53 is preferably circumferentially formed in the inner wall portion 14*a* of the lower stationary vessel sidewall section to allow the return of condensed vapor, formed on (or produced in the region of) the cooled inner wall surfaces of the upper retractable sidewall section 13, to the base region of the vessel for re-boiling. An optional condensate channel 54, as shown, interconnects the base of the upper sidewall section-receiving channel 41 with an intermediate region of the condensate channel 53. The channel 54 insures that any condensate that might possibly seep between the inner surfaces of the upper sidewall section 13 and the mating outer wall surface of the layer of insulation 22 could not accumulate within the channel 41.

In connection with the construction of the vessel 11 in the apparatus 10 of FIGS. 1 and 2, the upper edges of both the upper and lower sidewall sections 13 and 14 are not only adapted to support the circuit board 18 to be heated, as previously noted, but the cross-sectional open top area of the vessel is also preferably chosen such that the various codes of circuit boards to be heated will completely close the vessel top when properly mounted thereon. In situations when this is not practicable because of the size of the circuit boards and/or the vessel, a suitable metal frame (not shown) dimensioned to extend across the open top of the vessel, and formed with a central opening corresponding to only the underside surface area of a given circuit board to be heated, may be readily interposed between the top peripheral edges of the upper vessel sidewall section 13 and the underside of the circuit board.

In accordance with another related aspect of the invention, as illustrated in FIG. 5, primarily concerned with a second preferred embodiment of the invention, illustrated in FIGS. 3 and 4, a patterned mask 57, such as of stainless steel, and formed with any desired number of selectively dimensioned and precisely located windows 58, may be readily interposed between the top peripheral edges of the upper sidewall section 13, and a circuit board 18 either directly or indirectly mounted thereon. Such a mask advantageously results in the hot saturated vapors generated within the vessel being directly exposed to, and heating, only the desired precisely defined and discrete solder connection areas or sites 59' on the underside of the circuit board which are respectively aligned with the mask-defined windows 58, depicted in FIG. 5. Such selective heating may be of particular advantage, for example, with respect to the repair of circuit boards, such as when only one or several soldered connections are to be unsoldered and, after component replacement, resoldered, or when certain areas of a circuit board supporting very heat sensitive components cannot be subjected to the requisite temperature exhibited by the generated body of vapor without adversely affecting such components.

In connection with the general operation of the apparatus 10 of FIGS. 1 and 2 for heating articles, the heat transfer liquid 26 is introduced into the vessel 11 to the level indicated by the reference numeral 26*a*, as previously described, and brought to and maintained at a boiling state by means of electrical current from a source (not shown) applied through the lead-in wires 23*a* to the heating coil 23. With particular reference to soldering applications, the heat transfer liquid employed should exhibit the follow-general properties:

(a) a boiling point at atmospheric pressure at least equal to and preferably slightly above, the temperature required for the soldering (or fusing or brazing) operation to be performed - for example, in a soldering operation, this boiling point is at least equal to, and preferably above, the melting point of the solder used in the operation;

(b) must produce a saturated vapor which is denser than air at atmospheric pressure;

(c) desirably have a well defined and substantially constant boiling point for better control over the process, and (d) desirably produce a saturated vapor which is non-oxidizing, chemically stable and inert, non-toxic and non-inflammable.

In addition to the general properties hereinabove recited, when the methods and apparatus for its practice are employed to heat a printed circuit board having various leaded electrical components to be soldered thereto, the single heat transfer liquid should also normally not be electrically conducting.

When utilizing a solder that melts, for example, at 369° F. (182.2° C.), for a particular printed circuit board soldering application, one preferred heat transfer liquid is a formulation selected from the group of liquids known generically as Fluorocarbons, such as fluoronated polyoxypropylene. One such liquid is sold by E. I. DuPont de Nemours and Company, under the tradename "Freon E5", and has the following specific significant properties:

Boiling point at atmospheric pressure—435.6° F. (224.2° C.).

Electrical Resistivity—greater than $4\times10^{14}$ ohm-cm.

Dielectric constant—2.45.

Latent heat of vaporization—19.9 btu/lb.

Density of saturated vapor at boiling point.

Atmospheric pressure—1.45 lb/ft$^3$.

Chemical stability, inertness, non-toxicity and non-flammability.

Another suitable heat transfer liquid applicable for use with the aforementioned type of solder is sold by the Minnesota Mining and Manufacturing Company under the tradename "Fluorinert FC-70", and has the following significant properties:

Boiling point at atmospheric pressure—419° F. (215° C.).

Dielectric constant—1.94.

Latent Heat of vaporization—23 btu/lb.

Density of saturated vapor at boiling point.

Atmospheric pressure—1.27 lb/ft$^3$.

Chemical inertness and non-flammability. With respect to both "Freon E5" and "Fluorinert FC-70", they are also electrically non-conducting.

Two additional heat transfer liquids that substantially exhibit the above-defined properties, but to a lesser extent than "Freon E5" and "Fluorinert FC-70", are "Freon E4", sold by the E. I. DuPont de Nemours and Company, and perchlorethylene. With respect to "Freon E4", "Freon E5" and "Fluorinert FC-70", they have all been found to work particularly well not only with solder melting at approximately 359° F. (182.2° C.), but with tin-lead-eutectic solder, in general, whereas perchlorethylene has been found to work most effectively with tin-indium-cadmium solder.

With reference again to the apparatus 10 illustrated in FIGS. 1 and 2, and particularly to the operation thereof, it is assumed as a starting reference point, that a proper amount of heat transfer liquid 26 has previously been introduced into the composite vessel 11 and heated to its boiling point by the heating coil 23 alone, or in conjunction with external heat also applied to the vessel, such as to the base thereof by means of an auxiliary hot plate. The resultant generated body of hot saturated vapor **26*b* is continuously confined within the lower stationary vessel sidewall section 14, because the upper boundary of the vapor is prevented from rising as a result of the vapor barrier 48 established by the internally cooled, and initially completely exposed, inner wall surfaces of the upper retractable vessel sidewall section 13**.

Upon a given circuit board 18 being mounted directly on the upper peripheral edges of the upper vessel sidewall section 13 (or indirectly mounted on a suitable frame, not shown or optional mask 57, see FIG. 5), it is forced downwardly onto the upper peripheral edges of the lower stationary vessel sidewall section 14, as illustrated in FIG. 2. During such downward displacement, the underside of the circuit board is preferably passed slightly through the previously established and substantially stationary vapor body-vapor barrier interface and, thereby, is brought into direct contact with the saturated body of hot vapor so that a desired material melting operation (e.g., soldering) may be performed thereon. During such downward circuit board displacement, as previously noted, any air that is entrapped between the underside of the circuit board and the upper boundary of the generated body of hot vapor is expelled through the small operably controlled vent (or vents) 51 in the upper retractable vessel sidewall section 14. As previously mentioned, this minimizes the reduction of condensation heat-transfer of the generated body of vapor due to the presence of non-condensible air.

In a typical soldering application, the saturated vapors from the generated body **26*b* thereof rise to the exposed underside surface area (or areas) of the circuit board and condense thereon, giving up their latent heat of vaporization to heat the surface, and particularly, the metallic solder connection sites thereon. Such sites are illustratively identified by the reference numeral 59 on the underside of the circuit board 18, and would normally comprise through-hole extending lead ends of circuit components 63, which lead ends are respectively surrounded by printed circuit land areas, or pads 64, the latter being selectively connected to printed circuit paths 66**.

Whenever an optional patterned mask of the type depicted in FIG. 5 would be employed, only the precisely defined discrete areas on the underside of the circuit board exposed through the windows of the mask would be directly heated by the generated body of hot vapor. In accordance with the illustrative embodiment of FIGS. 1 and 2, such a mask would normally be dimensioned so as to rest directly on the upper peripheral edges of the upper side wall section 13.

Regardless how the desired solder sites are exposed to the vapor, the temperature thereof will rise until the solder thereon is near or reaches the temperature of the saturated vapor body. That temperature, of course, is the boiling point of the heat transfer liquid employed, and must at least equal, but preferably be slightly higher than, the melting point of the particular solder employed. By way of example, for a solder having a liquidus temperature of approximately 359° F. (182° C.), the boiling temperature of the heat transfer liquid should preferably be from 10° to 50° higher than the solder liquidus temperature. In a typical circuit board soldering application, the solder may be initially applied to the circuit boards either in the form of solder pre-forms, or in the form of a general solder coat applied thereto, with the vapor-induced re-flow of the solder pre-forms, or solder coat, being required to effect reliable and permanent soldered connections.

Advantageously, the exposed metallic surfaces on the underside of the circuit board 18 approach or reach the temperature of the hot saturated vapor body quite rapidly, because the heat transfer coefficients for condensation processes are among the highest ones known for any mode of heat transfer. This significantly minimizes the time required for the circuit board to be subjected to the heat of the saturated vapor body. As such, the time is very short during which there could be any possible thermal degradation of any heat sensitive electrical components mounted on the top side of the circuit board.

After the soldering (or unsoldering) operation, the then soldered circuit board 18, together with the upper retractable vessel sidewall section 13 on which it is mounted, are allowed to rise in response to the biasing force exerted against the latter by the plurality of helical coil springs 38, until reaching their respective elevations depicted in FIG. 1. During such displacement, the mounted circuit board cooperates with the internally cooled inner walls of the upper vessel sidewall section 13 so as to continuously minimize any otherwise possible loss of vapor to the atmosphere.

Simultaneously with such upward displacement, the resulting re-opening of the vent 51 allows air to again flow back into the area of progressively increasing volume defined by the rising upper sidewall section 13. This re-establishes a vapor barrier 48 of maximum depth, and volume, which while maintained effectively prevents any appreciable migration of the hot body of vapor therethrough, with a consequent loss thereof to the atmosphere. With the vapor barrier 48 thus re-established, the previously soldered circuit board 18 may be removed from the vessel and a new circuit board to be solder mounted thereon.

The cooling coil 29 associated with the vent pipe 28, of course, also contributes to minimizing any loss of vapor to the atmosphere, while at the same time allowing the generated vapor body to remain at approximately atmospheric pressure at all times, as required in order to obtain consistently uniform heating of articles, in general, in accordance with a vapor condensation process.

From the foregoing, it is seen that the first illustrative method and structural embodiment of the invention significantly provides an effective and simplified way of confining only one heat-producing vapor body within an open top composite vessel of compact construction, and wherein no secondary vapor blanket or retractable (or otherwise removable) cover plate is required to minimize vapor loss to the atmosphere. In addition, in accordance with the first embodiment, the generated vapor body advantageously continuously remains within a given lower vessel area of uniform volume, which allows only the underside surface (or selected discrete areas thereof) of a vessel-mounted article to be controllably displaced downwardly until exposed to, and thereafter heated by, only the substantially stationary upper boundary of the vapor body.

FIGS. 3 and 4 illustrate a second preferred embodiment of the invention wherein a vapor condensation apparatus 60 distinguishes over the apparatus 10 of FIGS. 1 and 2 only with respect to the manner in which an article to be heated, such as a circuit board 18', with components 63' to be soldered thereto, together with the optional patterned mask 57, are both mounted in a unique manner within respectively associated channels of a guide rail assembly 68. The latter is secured to the upper peripheral edges of a modified retractable vessel sidewall section 13'.

It should be appreciated, of course, that should the thickness of the upper sidewall section 13' be relatively thin in a given composite vessel, the upper section thereof may be formed with an integral, partial top wall (not shown) that would extend a short distance inwardly of the top peripheral edges of the lower vessel section, and within which a central article-exposing opening of the desired dimensions would be formed. Such an opening would normally be dimensioned so as to allow the desired underside surface area of any particular article, such as the circuit board 18', to be exposed to, and heated by, the hot body of vapor therebelow.

As most of the basic structural elements of the vessel in the apparatus 60 of FIGS. 3 and 4, as well as of the associated circuit board, are either identical to, or at least substantially similar to the corresponding elements in, or associated with, the apparatus 10 of FIGS. 1 and 2, like, but primed, reference numerals are used in FIGS. 3 and 4 to show such illustrated correspondence.

As noted above, the guide rail assembly allows not only the circuit board 18', but the aforementioned optional mask 57, formed with a suitable pattern of windows 58, as best seen in FIG. 5, to be mounted thereon. In this manner, only discrete solder connection sites 59' on the underside of the circuit board 18' are directly heated. It is recognized that whenever an optional mask is employed, the underside of the circuit board may necessarily be at an elevation slightly above the top peripheral sidewall edges of the lower vessel section. While this would slightly shift the vapor body-vapor barrier interface and, hence, also very slightly increase the volume of vapor, this exceedingly small displacement of the vapor interface would normally have no adverse consequences in most article heating operations. Moreover, as described in greater detail hereinbelow, suitably positioned vapor sealing elements associated with the guide rail assembly would insure that no vapor would be lost to the atmosphere through any article-mask-guide rail assembly structural interfaces.

The guide rail assembly 68 may basically be of the type employed in several preferred embodiments of a vapor condensation apparatus disclosed in the aforementioned R. C. Pfahl application, Ser. No. 864,305. To that end, the guide rail assembly comprises a pair of guide rails 81, 82, and a stop member 84, all secured to different upper peripheral edges of the upper retractable sidewall section 13'. The guide rails 81, 82 are respectively disposed in parallel relationship on two mutually disposed upper section sidewalls, and are each formed with a longitudinally extending undercut shoulder 81*a*, and a closely spaced groove 81*b* (or 82*a, b*). The groove and undercut shoulder in each guide rail are dimensioned to respectively receive longitudinally disposed edge portions of the circuit board 18' and optional mask 57, respectively. It is appreciated, of course, that the undercut shoulders and grooves in the guide rails 81, 82 are respectively aligned so as to maintain the circuit board and optional mask in proper spatial relationship at all times. If desired, an upper groove (not shown) rather than the undercut shoulder 81*a* (or 82*a*) could be formed in each guide rail to receive an adjacent longitudinally disposed edge of the circuit board in sliding and close fitting relationship therewith.

Each of the guide rails 81 and 82 are also preferably formed with a plurality of key-way adjusting slots 81*c*, 82*c* (best seen in FIG. 5) that are oriented so as to allow the spacing between the guide rails to be adjusted, through the use of threaded fasteners 81*d*, 82*d*, so as to accommodate circuit boards (or other articles) having different width dimensions. In this regard, it is appreciated that a different optional mask 57 (or simple frame) may be required in certain situations to correspond with either the total cross-sectional area, or the area to be heated, of a given circuit board. Conversely, different matched pairs of guide rails similar to 81 and 82, but having support grooves formed therein with different predetermined depths (not shown), could also be employed to accommodate a number of different width and/or length dimension-combinations for the circuit board and optional mask.

The aforementioned stop member 84 interconnects two common ends of the guide rails 81 and 82, and preferably is also formed with an undercut shoulder 84*a* and a groove 84*b* that are respectively aligned with those corresponding thereto in the guide rails so as to receive the forward edge regions of the circuit board 18' and the optional mask 57, respectively. Such a stop member thus also contributes in minimizing loss of vapor generated within the vessel to the atmosphere.

In order to minimize any loss of vapor in the space between an optional mask and a vessel-mounted circuit board, on the front side of the guide rail assembly, i.e., opposite the stop plate 84, a vapor sealing plate 91 is shown secured to the upper peripheral edge of the front sidewall of the upper vessel section 13' by means of fasteners 94, so as to be in contact with the front face portions of the guide rails 81, 82. This allows the sealing plate 91 to accommodate different side rail spacings. Such a sealing plate could be readily dimensioned so as to be in close-fitting, adjustable relationship with both the optional mask 57 and circuit board 18'. The sealing plate may be formed out of any suitable material that is capable of withstanding the temperature of the generated body of vapor, exhibits good wearability, and preferably has at least a slight degree of resiliency.

It should be understood that if there is no need for a mask 57 in a given application, the vapor sealing plate 91 may be readily replaced with a similar plate (not shown) that has no slot to accommodate a mask, thus further minimizing any loss of vapor to the atmosphere. This would only be of value, however, should the upper vessel section 13' not be capable of being retracted, in the absence of a mask, to a position whereat the underside of the circuit board 18' would bottom on the top peripheral edges of the lower vessel sidewall section 14'. Generally, in the absence of a mask, it is preferable to allow the underside of the article to bottom on the top side of the vessel section 14' so as to maintain the upper boundary of the hot body of vapor at a relatively stationary elevation at all times.

It should also be realized that separate pairs of adjustable vapor sealing plates (not shown) may be respectively associated with the mask and circuit board, and mounted on the front faces of the guide rails, for example, so as to provide any degree of close-fit contact therewith as deemed necessary for a given application. Each pair of such members could also be readily mounted in a spring-biased manner, if desired, so as to provide a continuous, positive, clamping type of contact against opposite sides of the mask and/or circuit board interposed therebetween. In addition, the vapor sealing plate (or plates) in question could simultaneously function as scrappers to remove any condensate from the underside of either the mask or circuit board upon their being removed in a sliding manner from the guide rail assembly 68.

In connection with the optional mask and circuit board supporting grooves and undercut shoulders formed in the guide rail assembly 68 of the second embodiment, it should also be appreciated that in certain applications a single pair of spaced and aligned grooves (not shown) may be employed to accommodate both of these elements. Such an arrangement may be of particular advantage when close registration is required between discrete vapor-exposing apertures or windows formed in the mask, and aligned discrete areas on the underside of the circuit board to be heated. Such a requirement may be necessary in certain soldering applications, for example, in order to protect heat-sensitive components and/or circuitry positioned closely adjacent the solder connection sites. When such registration is important, the patterned mask 57 may be formed with two or more upstanding pilot or positioning pins (not shown) located so as to allow registry with pre-formed, pin-receiving apertures (not shown) formed through the circuit board 18'.

If desired, apertured spacers of suitable heat resistant material may also be coaxially mounted on pins of the type in question, and dimensioned so as to provide any desired degree of clearance between the adjacent surfaces of a particular circuit board and mask in order to carry out a desired heat-induced opertion on the former. It should also be appreciated that a pilot pin-aligned mask and circuit board may be temporarily clamped together, such as by means of several spaced C-clamps (not shown), for mounting on the top of a vessel of the type depicted in FIG. 1, as well as on a guide rail assembly of the type illustrated in FIGS. 3 and 4.

For most vapor condensation article heating applications, the internally cooled sidewalls of the upper vessel sidewall section 13' are very effective, particularly when of appreciable height, to establish an effective vapor barrier therewithin of sufficient depth to minimize any appreciable loss of the relatively expensive vapor to the atmosphere, in the absence of a vessel mounted article. Nevertheless, in certain mass soldering operations, and particularly when the planar surface area of a given circuit board to be soldered is quite large, it may possibly develop that the upper central region of the established vapor barrier, even when of maximum depth, and volume, may not always prove to be sufficiently dense (with saturated moisture) to completely condense all of the hot and continuously generated vapor therebelow. In such a case, an optional cover plate (not shown) could be used in such a heating application to further minimize the possibility of any appreciable loss of the vapor to the atmosphere in the absence of a vessel-mounted circuit board. To that end, such a cover plate could be retractably (or otherwise removably) mounted on the guide rail assembly 68 so as to close the vessel top whenever an article to be heated is not mounted thereon. Such a cover plate could also be optionally internally cooled, and/or tilted, to facilitate the run-off of condensate from the underside thereof in a manner similar to that disclosed in the aforementioned Pfahl U.S. Pat. No. ('297). It is reiterated, however, that for most vapor condensation article heating applications, no cover plate, whether heated or not, would normally be required when using the uniquely constructed composite vessels of the type embodied herein.

In view of the foregoing, it is seen that the subject methods of the present invention, regardless of which one of the preferred structural embodiments is employed to perform a heating operation on a selected underside surface of an article, involves the following basic and significant operational steps: First, a heat transfer liquid is boiled substantially at atmospheric pressure to form an initially co-extensive body of condensible vapor, with the latter confined by the peripheral sidewalls and lower base of a lower vessel sidewall section, and by a relatively stationary upper boundary defined by either a vapor body-vapor barrier interface, or by an overlying article to be heated. Secondly, the article to be heated is positioned at a first elevated position relative to an initially established vapor barrier overlying the body of hot vapor generated therebelow such that only the selected underside surface (or masked areas) of the article is initially exposed to the vapor barrier, while the article at the same time, at least in part, facilitates the top side closure of the composite vessel to further minimize any loss of the generated vapor to the atmosphere through the previously established and volume-controllable vapor barrier. Thirdly, each positioned article to be heated is moved downwardly from the first elevated position to a second elevated position, causing the vapor barrier of previously established maximum depth and volume to progressively decrease until eliminated. At the second (lower) elevated position, preferably slightly below the initially established vapor body-vapor barrier interface, the selected underside surface of the article is brought into direct contact with the saturated body of hot vapor so that a material melting operation may be performed thereon. Fourthly, any air that may become entrapped within the volume-controllable vapor barrier, as defined between the selected underside surface of the article while moved from the first elevated position to the second elevated position, is vented to the atmosphere so as to minimize the reduction of condensation heat-transfer due to the presence of non-condensible air. Fifthly, the heated article is raised from the second elevated position back to the first elevated position prior to the removal of the article from the vessel, while simultaneously effecting the re-establishment of a new vapor barrier of progressively increasing volume, and depth, until the maximum volume and depth thereof is attained, so as to again minimize any loss of vapor to the atmosphere upon the removal of the article from the vessel while at the first elevated position.

While several related and preferred vapor condensation embodiments and methods have been disclosed herein, it is obvious that various other modifications may be made to the present illustrative embodiments and methods of the invention, and that a number of alternative related embodiments and methods could be devised by one skilled in the art without departing from the spirit and scope of the invention.

What is claimed is:

1. An apparatus for generating a body of hot condensible vapor of a heat transfer liquid for heating a selected underside article surface controllably exposed thereto by the transfer of the latent heat of vaporization of the vapor to the article, comprising:

a volume controllable vessel comprising upper and lower vessel sections, the upper section having at least a substantially open top, and being adapted to support an article to be heated on the top side thereof, with the lower section including means to vent said section to the atmosphere, and having integral stationary sidewall and base portions, said lower section being further adapted to telescopically receive within a continuous sidewall-formed interior channel thereof at least the major portion of said upper vessel section;

biasing means associated with said upper and lower vessel sections for normally maintaining said upper section at an uppermost elevation relative to said lower section, but in response to a predetermined downward force applied thereagainst, causing the selected underside surface of a vessel-mounted article to be displaced downwardly until exposed to, and heated by, a body of hot vapor when generated and confined within the lower section of said vessel, said upper vessel section further including internal sidewall cooling means for establishing, in response to a generated body of hot vapor therebelow, a vapor barrier of controllable depth and volume therewithin so as to prevent any appreciable loss of vapor to the atmosphere in the absence of a vessel-mounted article, the depth and volume of said established vapor barrier being dependent on the position of said upper vessel section relative to said lower vessel section at any given time, with said vapor barrier being completely eliminated upon a vessel-mounted article being displaced downwardly from its initially mounted position to a position whereby the selected underside thereof is brought into contact with the upper boundary of a body of hot vapor when generated, and confined, within said lower vessel section, and means for boiling a lower vessel section-confined supply of heat transfer liquid to generate a body of condensible hot vapor therefrom.

2. An apparatus in accordance with claim 1, wherein said upper and lower sections of said vessel define a four-sided interior, and wherein said upper vessel section includes at least one operably sealable vent positioned so as to allow any air that may become entrapped between a selected underside surface of an article, initially supported on the upper vessel section, and the upper peripheral sidewall edges of said lower vessel section to be expelled as the article is displaced downwardly until said selected surface thereof is brought into contact with a generated body of hot vapor confined within said lower vessel section.

3. An apparatus in accordance with claim 2, wherein said biasing means comprises a circumferentially disposed array of helical coil springs that are vertically mounted within said channel formed in said lower vessel section, and wherein said lower vessel section venting means includes cooling means for preventing the loss of any generated vapor to the atmosphere therethrough.

4. An apparatus in accordance with claim 3, wherein said upper vessel section further includes guide rail assembly means secured thereto for supporting an article to be heated.

5. An apparatus in accordance with claim 4, further including a substantially planar mask formed with a predetermined apertured pattern so as to allow only an area corresponding thereto on the selected guide rail assembly means supported article surface to be exposed to a hot saturated body of vapor when generated within said vessel, said mask being interposed between the top of said upper vessel section and the article to be heated, and also supported on said guide rail assembly.

6. An apparatus in accordance with claim 4, wherein said operably sealable vent is closed by an upper portion of the adjacent lower vessel section sidewall, upon said upper vessel section being at least substantially completely telescopically received within said lower vessel section.

7. An apparatus for generating a body of hot condensible vapor of a heat transfer liquid for heating a selected underside article surface controllably exposed thereto by the transfer of the latent heat of vaporization of the vapor to the article, comprising:

a vessel for confining a supply of heat transfer liquid therewithin, said vessel including upper and lower sidewall sections with at least the former being adapted to selectively support a planar configured article to be heated thereon, and wherein the lower section, which includes an integral base, is of greater height than the upper section, and formed with a continuous interior sidewall channel adapted to telescopically receive at least the major portion of said upper section therewithin;

biasing means confined within said channel for supporting said upper sidewall section for vertical retractable displacement within said channel, said upper sidewall section normally being maintained by said biasing means at an uppermost elevation relative to said lower section, but in response to a predetermined downward force applied thereagainst, established at least in part by an article to be heated when mounted thereon, causing the selected underside surface of such mounted article to be displaced downwardly until exposed to, and heated by, a body of hot vapor when generated and confined within the lower sidewall section of said vessel, said upper side wall section further including internal sidewall cooling means for establishing a vapor barrier of controllable depth and volume for condensing any hot vapor that tends to rise to the elevation of any given controllably exposed and cooled sidewall surface area, so as to prevent any appreciable loss of vapor to the atmosphere in the absence of a vessel-mounted article which closes the otherwise open top of the vessel;

means for boiling a lower vessel section-confined supply of heat transfer liquid to generate a body of condensible hot vapor therefrom, and means secured to said lower vessel sidewall section for venting the vessel to the atmosphere.

8. An apparatus in accordance with claim 7, wherein said upper and lower sidewall sections of said vessel define a four-sided interior, wherein said venting means also includes cooling means for preventing the loss of any generated vapor therethrough to the atmosphere, and wherein said upper vessel section further includes controllably opened and closed vent means located near the upper peripheral edge thereof, and extending therethrough.

9. An apparatus in accordance with claim 8, wherein said biasing means comprises a circumferentially disposed array of helical coil springs vertically mounted within said channel of said lower vessel side wall section.

10. An apparatus in accordance with claim 7, wherein said upper retractable vessel sidewall section includes at least one operably sealable vent positioned so as to allow any air that may become entrapped between the underside of a vessel-supported article and the upper boundary of a generated body of hot vapor, while the former is progressively displaced downwardly until contacting the latter, to be expelled to the atmosphere.

11. An apparatus in accordance with claim 10, further including a substantially planar mask formed with a predetermined apertured pattern so as to allow only an area corresponding thereto on the selected vessel-supported article surface to be exposed to a hot saturated body of vapor when generated within said lower vessel section, said mask being interposed between the upper peripheral edges of said upper sidewall section and the article to be heated, and also supported on said latter vessel section.

12. An apparatus in accordance with claim 8, wherein said upper vessel sidewall section includes a guide rail assembly, said assembly comprising at least a pair of guide rails respectively mounted on the upper peripheral edges of two mutually disposed upper vessel section sidewalls, said guide rails extending in parallel relationship, with each of said guide rails having at least one longitudinally extending recessed area formed in an inner, vertically oriented sidewall thereof, with the corresponding recessed areas in said guide rails being aligned and spaced apart such that they are adapted to support mutually disposed and respectively associated edge portions of an article to be heated, and wherein said guide rail assembly further includes a stop member extending between and abutting one pair of common terminating ends of said guide rails, and supported on the upper peripheral edge of one of said upper vessel section sidewalls interposed between said sidewalls respectively supporting said pair of guide rails.

13. An apparatus in accordance with claim 12, further including a substantially planar mask formed with a predetermined apertured pattern so as to allow only an area corresponding thereto on the selected guide rail-supported article surface to be exposed to a hot saturated body of vapor when generated within said vessel, said mask being interposed between the upper peipheral edges of said upper side wall section and the article to be heated, and also supported on said guide rails.

14. An apparatus in accordance with claim 13, wherein a second longitudinally extending recessed area is fromed in each of said guide rails, and is positioned closely adjacent but below said first recessed area, said mutually disposed pair of second recessed areas being adapted to respectively support mutually disposed edge portions of said planar mask so as to position the latter in close, parallel and underlying relationship with a guide rail assembly-mounted article.

15. A method of performing a heating operation at an elevated temperature on only a selected underside surface of an article, comprising the steps of:

boiling a heat transfer liquid substantially at atmospheric pressure to form an initially co-extensive body of hot condensible vapor of the heat transfer liquid at the elevated temperature, while being selectively confined with respect to base and side boundaries, and substantially completely confined with respect to an upper boundary;

establishing an initial vapor barrier confined, but of controllable volume and depth, above said vapor body, the lower boundary of said vapor barrier being defined by a relatively stationary vapor body-vapor barrier interface;

positioning an article at a first elevated boundary that at least substantially coincides with an initial upper boundary of said vapor barrier, while the latter is of predetermined maximum depth and volume, so that the selected underside surface of the article is initially exposed to the vapor barrier;

displacing the article to be heated downwardly from said first elevated boundary to a second elevated boundary while causing the depth and volume of said vapor barrier to progressively decrease until the latter is eliminated when the selected underside of the article coincides with the initially established vapor body-vapor barrier interface, said selected article surface at that time being exposed to, and heated by, the hot vapor body, and said article while at said second elevation, at least in part, also facilitating the confinement of the vapor body therebelow, within said base and side boundaries therefor, so as to minimize any loss of vapor to the atmosphere;

raising the article from the second elevated boundary after the completion of a vapor condensation-induced heating operation thereon back to the first elevated boundary, said raising step re-establishing a vapor barrier of progressively increasing depth and volume overlying said body of vapor, until the maximum depth and volume thereof is re-established, thereby minimizing any loss of said hot vapor to the atmosphere upon the removal of the heated article from the first elevated boundary, with any resulting vapor barrier-entrapped condensate being directed back to the heat transfer liquid for re-boiling and re-use as part of the confined generated body of hot vapor.

16. A method in accordance with claim 15, wherein any air that may become entrapped within said vapor barrier while the depth and volume thereof is progressively decreased until non-existent is vented to the atmosphere.

17. A method in accordance with claim 15, wherein only predetermined discrete areas of the selected underside article surface are exposed to, and heated by, said vapor body while the article is positioned at said second elevated boundary.

18. A method in accordance with claim 16, wherein said second elevated boundary is located at an elevation slightly below the initially established vapor body-vapor barrier interface.

19. A method of performing a vapor condensation heat-induced operation on a selected underside surface of a substantially planar configured article while supported on a volume controllable vessel, wherein the vessel includes upper and lower vessel sections, the upper section having at least a substantially open top, internally cooled and vertically retractable sidewalls, and being adapted to support an article to be heated on the top side thereof, with the lower section including means to vent said section to the atmosphere and having stationary sidewall and base portions, and wherein the upper vessel section is normally biased to an uppermost position relative to said lower vessel section, said method comprising the steps of:

boiling a heat transfer liquid substantially at atmospheric pressure within the volume controllable vessel to form an initially co-extensive body of hot condensible vapor of the heat transfer liquid at an elevated temperature;

establishing an initial vapor barrier of controllable volume and depth within said upper vessel section so as to overlie said body of vapor and, thereby, minimize any loss thereof to the atmosphere, the lower boundary of said vapor barrier being defined by a relatively stationary vapor body-vapor barrier interface;

positioning an article to be heated on the top side of said upper vessel section while the latter is in the uppermost position, the selected underside surface of the article thus being initially exposed to said vapor barrier when the latter is of maximum depth and volume;

causing the upper vessel section and the selected underside surface of the article mounted thereon to be displaced downwardly relative to said lower vessel section until the selected underside article surface is exposed to, and heated by, the body of hot vapor generated and confined within the lower vessel section, with the sidewalls of the latter at that time shielding said upper vessel section sidewalls from said vapor; said downward displacement of said article causing said vapor barrier to progressively decrease from the initially established maximum depth and volume thereof to a non-existent state, and raising the upper vessel section and the article mounted thereon from the elevation whereat only the underside of the article is in contact with the hot vapor body, after the completion of a vapor condensation-induced heating operation thereon, back to the initially mounted elevation therefor defined by the uppermost position of said upper vessel section, said raising step re-establishing a vapor barrier of progressively increasing depth and volume overlying said vapor body until the maximum depth and volume thereof is re-established, thereby minimizing any loss of said hot vapor to the atmosphere upon the removal of the heated article from said upper vessel section, with any resulting vapor barrier-entrapped condensate being directed back from the upper vessel section to the lower vessel section for re-boiling and re-use as part of the confined generated body of vapor.

20. A method in accordance with claim 19, wherein any air that may become entrapped within said vapor barrier while the depth and volume thereof is progressively decreased until non-existent is vented to the atmosphere.

21. A method in accordance with claim 19, wherein only predetermined discrete areas of the selected underside article surface are exposed to, and heated by, said vapor body.

22. A method in accordance with claim 20, wherein the elevation of the selected underside of the article brought into contact with said hot body of vapor is slightly below the initially established vapor body-vapor barrier interface.

* * * * *